US009141065B2

(12) United States Patent
Mori

(10) Patent No.: US 9,141,065 B2
(45) Date of Patent: Sep. 22, 2015

(54) IMAGE FORMING APPARATUS

(71) Applicant: Hirotaka Mori, Nagoya (JP)

(72) Inventor: Hirotaka Mori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 317 days.

(21) Appl. No.: 13/780,299

(22) Filed: Feb. 28, 2013

(65) Prior Publication Data

US 2013/0243508 A1 Sep. 19, 2013

(30) Foreign Application Priority Data

Mar. 14, 2012 (JP) ..... 2012-057540
Nov. 14, 2012 (JP) ..... 2012-249935

(51) Int. Cl.
*G03G 15/00* (2006.01)
*G03G 15/20* (2006.01)

(52) U.S. Cl.
CPC ..... *G03G 15/657* (2013.01); *G03G 15/2028* (2013.01)

(58) Field of Classification Search
CPC ..... G03G 15/657
USPC ..... 399/322, 400
See application file for complete search history.

(56) References Cited

U.S. PATENT DOCUMENTS 5,166,737 A 11/1992 Tomita
6,347,214 B1 2/2002 Kaneko
7,899,386 B2 3/2011 Saeki et al.
2002/0131801 A1* 9/2002 Tomatsu ..... 399/400
2007/0098472 A1 5/2007 Saeki et al.
2008/0317532 A1* 12/2008 Ehara et al. ..... 399/400
2011/0103862 A1 5/2011 Saeki et al.

FOREIGN PATENT DOCUMENTS

JP 61047978 A * 3/1986
JP 63-066048 A 3/1988
JP 01-090476 A 4/1989
JP 03-228074 A 10/1991
JP 04-035146 U 3/1992
JP 05-333715 A 12/1993
JP 06-095525 A 4/1994
JP 06-258957 A 9/1994
JP 06-258972 A 9/1994
JP 06-317990 A 11/1994
JP 07-261562 A 10/1995
JP 2000-214689 A 8/2000
JP 2001-072281 A 3/2001
JP 2001-130784 A 5/2001

(Continued)

*Primary Examiner* — Erika J Villaluna
(74) *Attorney, Agent, or Firm* — Banner & Witcoff, Ltd.

(57) ABSTRACT

An image forming apparatus, including: an electrophotographic image forming unit which forms an image on a recording medium; a fixing unit which thermally fixes the image; an insulating chute disposed between the image forming unit and the fixing unit, including: a guide face and a back face, and configured to guide the image-formed recording medium to the fixing unit; and a planar metal member disposed on the back face and expanding to a first end edge portion as an edge portion of one of end portions of the chute nearer to the fixing unit. The metal member includes a second end edge portion that is an edge portion of one of end portions of the metal member nearer to the fixing unit. The second end edge portion has an acute angle in cross section as viewed in a widthwise direction of the recording medium.

12 Claims, 7 Drawing Sheets

(56) References Cited

FOREIGN PATENT DOCUMENTS

| | | | |
|---|---|---|---|
| JP | 2002-031960 | A | 1/2002 |
| JP | 2002-091182 | A | 3/2002 |
| JP | 2002-091183 | | 3/2002 |
| JP | 2002-156834 | A | 5/2002 |
| JP | 2002-182491 | A | 6/2002 |
| JP | 2002-251075 | A | 9/2002 |
| JP | 2002-268301 | A | 9/2002 |
| JP | 2003-233270 | A | 8/2003 |
| JP | 2004-277100 | A | 10/2004 |
| JP | 2004-277101 | A | 10/2004 |
| JP | 2004-277102 | A | 10/2004 |
| JP | 2004-277104 | A | 10/2004 |
| JP | 2005-075505 | A | 3/2005 |
| JP | 2007-127677 | A | 5/2007 |
| JP | 2011-007921 | A | 1/2011 |

* cited by examiner

IMAGE FORMING APPARATUS

CROSS REFERENCE TO RELATED APPLICATION

The present application claims priority from Japanese Patent Application Nos. 2012-057540 filed on Mar. 14, 2012, and 2012-249935 filed on Nov. 14, 2012, the disclosures of which are herein incorporated by reference in its entirety.

BACKGROUND OF THE INVENTION

1. Field of the Invention

The present invention relates to an image forming apparatus including an electrophotographic image forming unit configured to form an image on a recording medium and in particular to an image forming apparatus including a mechanism for guiding a recording medium after image forming to a fixing unit for thermally fixing the image.

2. Description of the Related Art

There is known an electrophotographic image forming apparatus configured to form an image on a recording medium such as a sheet using a developer such as toner, and in such an image forming apparatus, the recording medium after the image forming is guided to a fixing unit constituted by, e.g., a heated roller and a pressure roller, to thermally fix the image. However, since a large amount of charges are on the recording medium after the image forming, electric discharge may be caused between the recording medium and, e.g., the heated roller of the fixing unit, causing the developer to fly to disturb the image. As an image forming apparatus proposed to solve this problem, there is known an image forming apparatus that includes a chute for guiding a recording medium after image forming to a fixing unit and that is designed such that the chute has an opening formed in its face opposed to the recording medium, and needle-like grounded electrodes are exposed through the opening. In this design, the recording medium after the image forming can be guided to the fixing unit after the saw-toothed electrode eliminates electricity, suppressing occurrences of the image disturbance due to the electric discharge in some degree.

SUMMARY OF THE INVENTION

In this image forming apparatus, however, a clearance is formed between the needle-like electrode and the recording medium conveyed over the opening, but the size of this clearance varies with various conditions such as a material of the recording medium and the presence or absence of the opening.

Thus, a charged state of the recording medium guided to the fixing unit is sometimes uneven in a widthwise direction of the recording medium, i.e., in a direction perpendicular to a conveying direction in which the recording medium is conveyed. In this case, as illustrated in FIG. 7, the image on the recording medium is disturbed in streaks along the conveying direction.

The present invention has been developed to provide an electrophotographic image forming apparatus capable of suppressing occurrences of image disturbance on a recording medium in streaks along a conveying direction in which the recording medium is conveyed.

The present invention provides an image forming apparatus, comprising: an electrophotographic image forming unit configured to form an image on a recording medium; a fixing unit configured to thermally fixing the image formed on the recording medium by the image forming unit; a chute formed of an insulating material, the chute being disposed between the image forming unit and the fixing unit, the chute comprising: a guide face to be contacted by the recording medium; and a back face that is on a back of the guide face, the chute being configured to guide the recording medium on which an image is formed by the image forming unit, to the fixing unit in a state in which the recording medium is in contact with the guide face; and a planar metal member disposed on the back face of the chute, the metal member expanding to a first end edge portion that is an edge portion of one of end portions of the chute, wherein a distance between the one of the end portions of the chute and the fixing unit is less than a distance between the other of the end portions of the chute and the fixing unit, wherein the metal member comprises a second end edge portion that is an edge portion of one of end portions of the metal member, wherein a distance between the one of the end portions of the metal member and the fixing unit is less than a distance between the other of the end portions of the metal member and the fixing unit, and wherein the second end edge portion has an acute angle in cross section as viewed in a widthwise direction of the recording medium which coincides with a direction perpendicular to a conveying direction in which the recording medium is conveyed.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENTS

<Overall Structure of Image Forming Apparatus>

Figure 1:
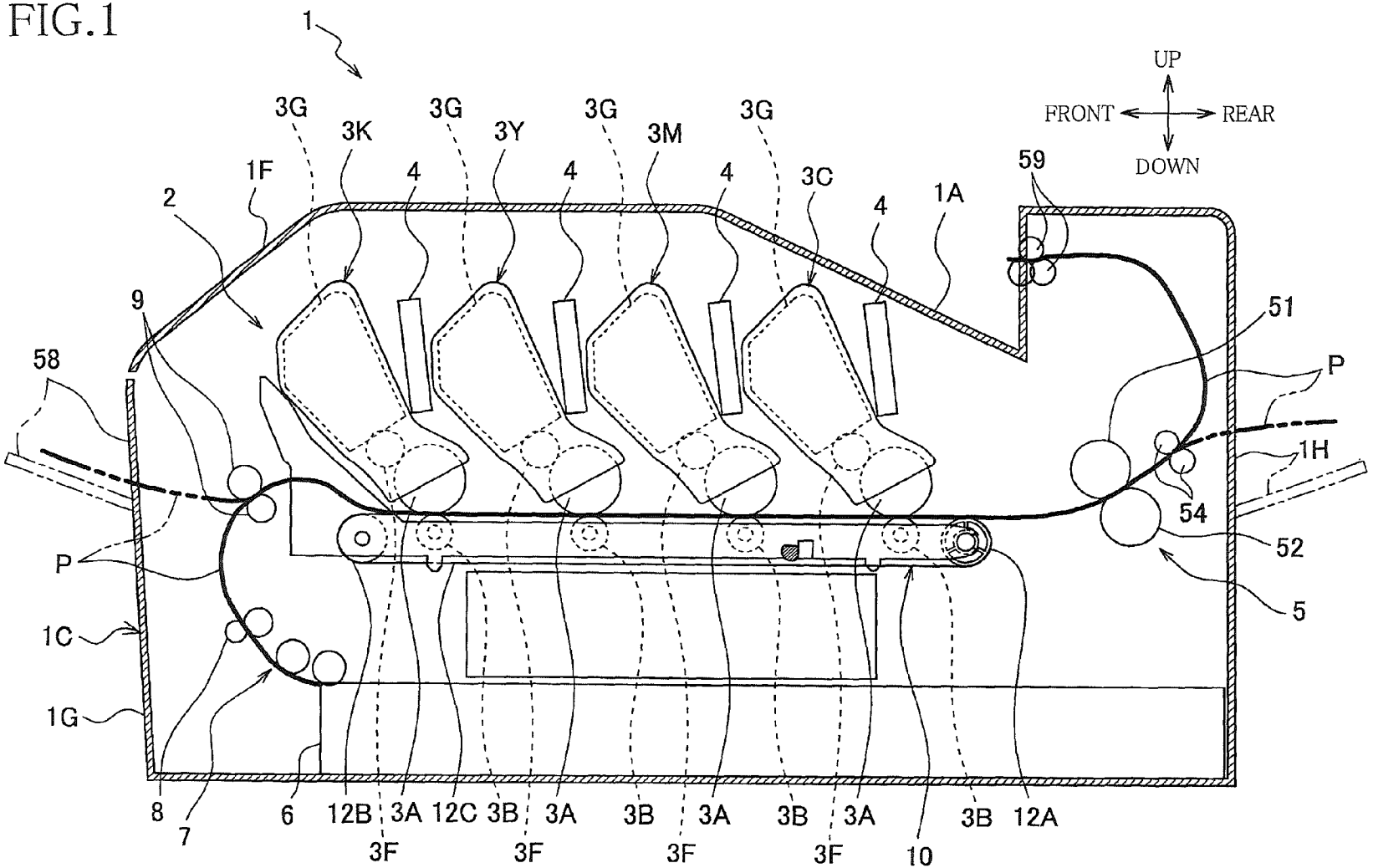
FIG. 1 is a central cross-sectional view schematically illustrating a structure of an image forming apparatus according to the present embodiment.

Hereinafter, there will be described one embodiment of the present invention by reference to the drawings. FIG. 1 illustrates a structure of an image forming apparatus 1 according to the present embodiment. In the following explanation, the left side in FIG. 1 is defined as a front side, and the right side as a rear side.

As illustrated in FIG. 1, the image forming apparatus 1 includes an image forming portion 2 as one example of an image forming unit configured to form an image on a recording medium in the form of a sheet P such as an OHP sheet. The image forming portion 2 includes four process cartridges 3K, 3Y, 3M, 3C and an exposing unit 4. It is noted that in the present embodiment, the image forming portion 2 adopts a direct tandem method in which four process cartridges 3K, 3Y, 3M, 3C corresponding to respective toners of four colors, namely, black, yellow, magenta, and cyan, respectively form four toner images, which are overlaid on top of each other on the sheet P to form a color image on the sheet P. Provided on a rear side of this image forming portion 2 is a fixing unit 5 which thermally fixes the toner image formed on the sheet P by the image forming portion 2.

A plurality of the sheets P is stacked on a sheet-supply tray 6. An uppermost one of the sheets P is picked by a well-known sheet-supply mechanism 7 that includes a sheet-supply roller and a sheet separating member. The picked sheet is conveyed by a pair of conveyor rollers 8 to a pair of registering rollers 9 that correct oblique conveyance of the sheet P. After this correction, the sheet P is conveyed to a belt unit 10.

The four process cartridges 3K, 3Y, 3M, 3C are provided on a side of the belt unit 10 on which a sheet conveying face of the belt unit 10 is located. The process cartridges 3K, 3Y, 3M, 3C are arranged in a row in this order from an upstream side in a conveying direction in which the sheet P is conveyed.

In this arrangement, the four-color toner images are sequentially transferred to the sheet P conveyed on the belt unit 10, and then the transferred toner images are heated and fixed on the sheet P by the fixing unit 5. After the operation in the fixing unit 5, the sheet P is conveyed upward and discharged onto a sheet-discharge tray 1A that is provided on a top face of the image forming apparatus 1.

It is noted that each of the process cartridges 3K, 3Y, 3M, 3C contains the following members: a photoconductor drum 3A for bearing or carrying a toner image; a charging unit 3E (see FIG. 2) for charging the photoconductor drum 3A: a developing cartridge 3G for applying toner to the photoconductor drum 3A using a developing roller 3F; and other printing components. The charged photoconductor drum 3A is exposed by the exposing unit 4 to form an electrostatic latent image on an outer circumferential face of the photoconductor drum 3A. Toner is then applied from the developing cartridge 3G to the photoconductor drum 3A using the developing roller 3F to form a toner image on the outer circumferential face of the photoconductor drum 3A such that the photoconductor drum 3A bears the image. The toner image is transferred to the sheet P by a transfer roller 3B energized with a transfer current.

The fixing unit 5 includes: a heated roller 51 for heating the toner to fix the toner image on the sheet P; a pressure roller 52 disposed opposite the heated roller 51 to press the conveyed sheet P onto the heated roller 51; and a pair of first sheet-discharge rollers 54 for conveying the sheet P having passed through a position between the heated roller 51 and the pressure roller 52, to discharge the sheet P from a casing 53 (see FIG. 2) of the fixing unit 5. Here, the first sheet-discharge rollers 54 may be omitted where appropriate. Also, the heated roller 51 may be replaced with a well-known heating member using other than the roller such as a belt and a film.

The belt unit 10 is disposed at a position opposed to the photoconductor drums 3A contained in the respective four process cartridges 3K, 3Y, 3M, 3C. This belt unit 10 is rotatable to convey the sheet P such that the toner images are sequentially transferred to the sheet P. Specifically, the belt unit 10 is constituted by: a drive roller 12A and a driven roller 12B respectively having rotation shafts that extend parallel to rotation shafts of the respective photoconductor drums 3A; a transfer conveyor belt 12C looped over the drive roller 12A and the driven roller 12B; and other components. The sheet P is conveyed, with the sheet placed on the transfer conveyor belt 12C. It is noted that a main body frame, not shown, of the image forming apparatus 1 is provided with a drive source that supplies a power to the drive roller 12A to rotate the transfer conveyor belt 12C, which in turn rotates the driven roller 12B.

The transfer conveyor belt 12C is opposed at its tensioned face to the photoconductor drums 3A contained in the respective four process cartridges 3K, 3Y, 3M, 3C, and this tensioned face acts as a flat sheet conveying face of the transfer conveyor belt 12C for conveying the sheet P. This sheet conveying face does not need to expand horizontally and may be slightly inclined. In the present embodiment, this sheet conveying face expands in a horizontal plane. Also, the transfer rollers 3B are arranged each at a position located on an opposite side of the sheet conveying face of the transfer conveyor belt 12C from a corresponding one of the photoconductor drums 3A in the belt unit 10. Energized with the fixed transfer current, each transfer roller 3B causes the toner image on the corresponding photoconductor drum 3A to be transferred to the sheet P.

Incidentally, the four process cartridges 3K, 3Y, 3M, 3C, and the belt unit 10 are removably mounted on the main body frame, not shown, covered with a housing 1C that forms an external appearance of the image forming apparatus 1. The fixing unit 5 is also provided in the housing 1C. A top cover 1F provided with the sheet-discharge tray 1A is pivotably attached to the housing 1C, that is, the top cover 1F can be opened and closed. When this top cover 1F is opened upward, a user can replace the four process cartridges 3K, 3Y, 3M, 3C.

A front cover 1G is provided on a front portion of the housing 1C such that the front cover 1G partly acts as a manual tray 58 that is openably attached to the housing 1C. When this manual tray 58 is opened as indicated by two-dot chain lines in FIG. 1, the sheet P can be supplied to the registering rollers 9 from a front side of the image forming apparatus 1 without supplied from the sheet-supply tray 6. Also, a rear cover 1H is openably provided on a rear portion of the housing 1C. When this rear cover 1H is opened as indicated by two-dot chain lines in FIG. 1, the sheet P conveyed through the fixing unit 5 can be discharged to a rear side of the image forming apparatus 1.

Figure 2:
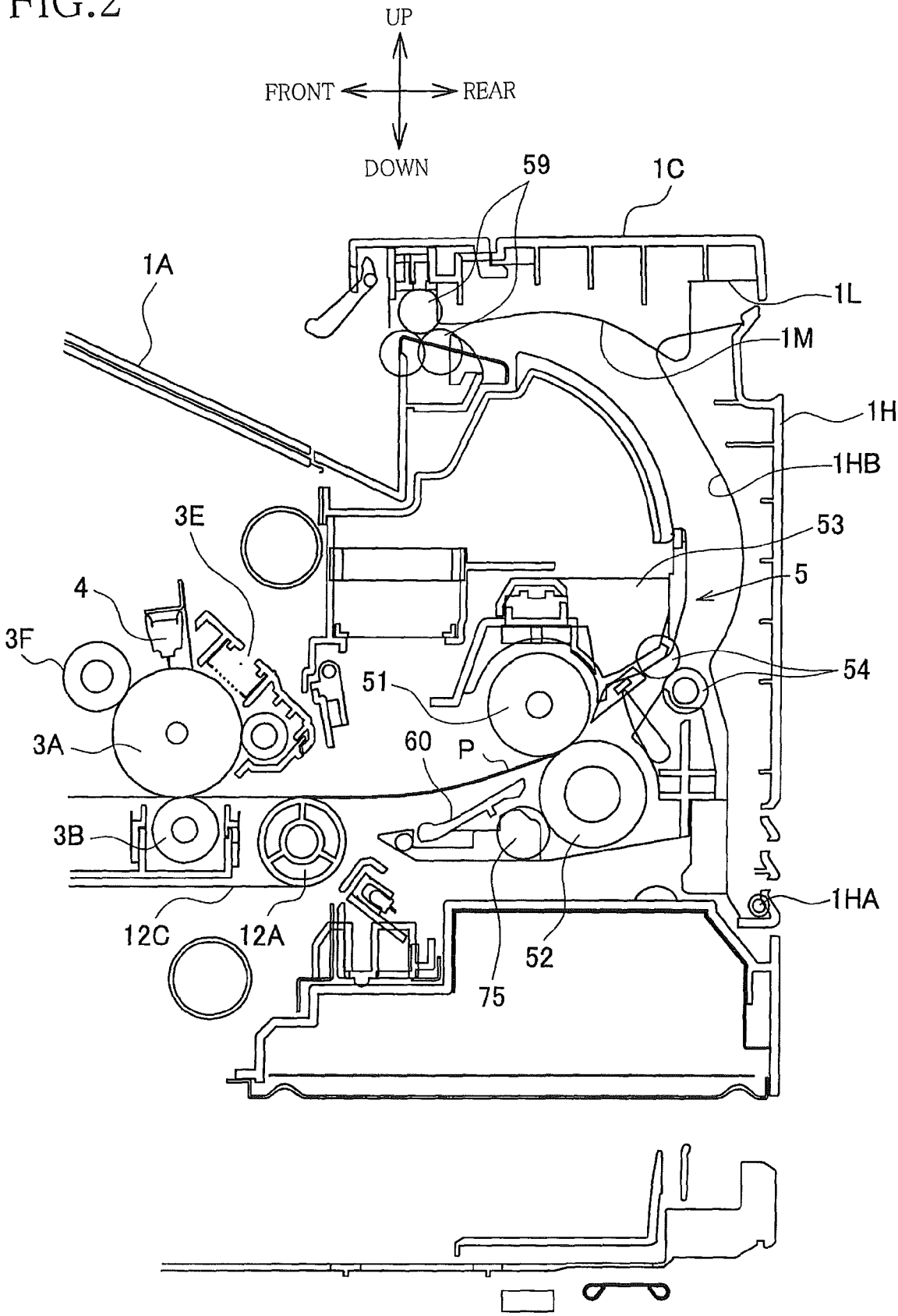
FIG. 2 is a cross-sectional view illustrating a structure of a portion of the image forming apparatus near a chute in detail.

As illustrated in FIG. 2, the rear cover 1H is, when opened, pivoted about a pivot axis 1HA. An opening 1L is formed in a rear portion of the housing 1C in the open state of the rear cover 1H. After the fixing of the fixing unit 5, the sheet P is discharged from the housing 1C through the opening 1L onto the rear cover 1H. When the rear cover 1H is closed, the opening 1L is also closed, inhibiting the discharge of the sheet P through the opening 1L. A guide 1HB is formed on an inner face of the rear cover 1H, and in the closed state of the rear cover 1H, this guide 1HB guides upward the sheet P conveyed by the first sheet-discharge rollers 54. In the closed state of the rear cover 1H, this guide 1HB is continuous to a guide 1M that is formed on an inner face of an upper portion of the housing 1C. After discharged from the fixing unit 5 by the first sheet-discharge rollers 54, the sheet P is conveyed while guided by these guides 1HB, 1M, and discharged onto the sheet-discharge tray 1A by second sheet-discharge rollers 59.

<Details of Fixing Unit and Chute>

As illustrated in FIG. 2, a chute 60 is provided between the image forming portion 2 and the fixing unit 5 (specifically, the heated roller 51 and the pressure roller 52) to guide the sheet P to a nip position between the heated roller 51 and the pressure roller 52. This chute 60 is provided at a position slightly lower than the sheet conveying face of the transfer conveyor belt 12C. The sheet P conveyed and attracted on the sheet conveying face of the transfer conveyor belt 12C is peeled from the sheet conveying face and guided to the nip position by the chute 60.

Figure 3A:
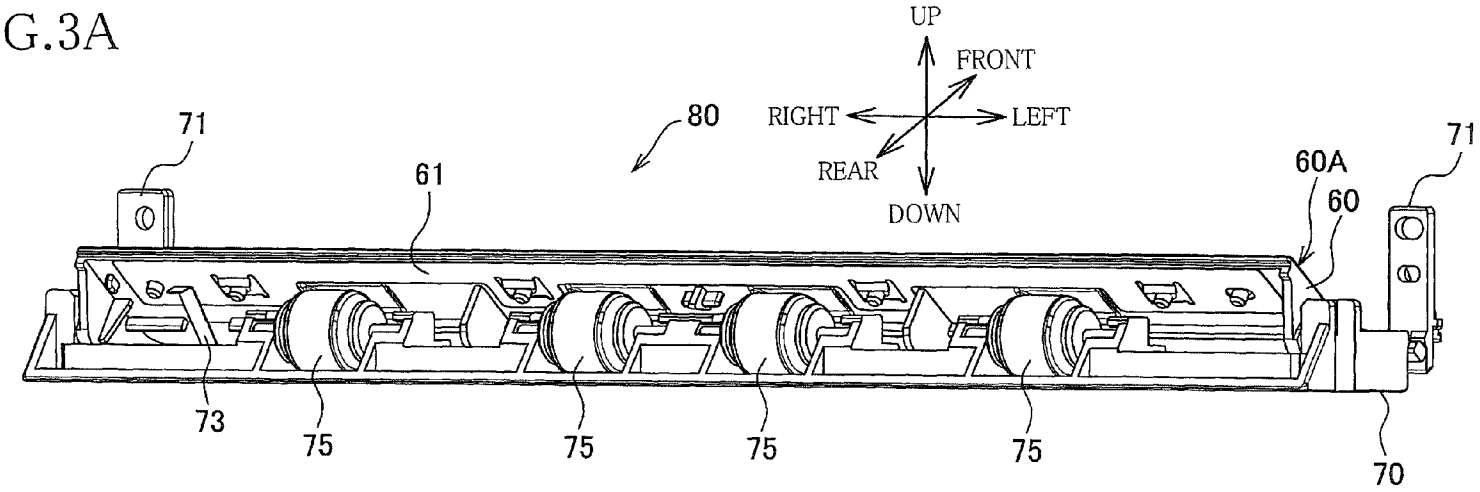
FIG. 3A is a perspective view illustrating a structure of an assembly including the chute.

FIG. 3A is an obliquely rear perspective view illustrating a structure of a chute assembly 80 constituted by the chute 60 and a support member 70 that supports the chute 60 on the main body frame. The chute 60 is formed of an insulating material (having electrical resistance of equal to or greater than $10^{10}$ Ω·cm, for example) such as resin. In a case where a sheet P is conveyed with a toner image having been transferred to one face of the sheet P, the chute 60 guides the sheet P to the nip position in a state in which the other face of the sheet P is in contact with an upper front face 60A of the chute 60 as a guide face for guiding the sheet P. The chute 60 has a back face 60D as a bottom face of the chute 60. A thin metal plate or sheet 61 as one example of a metal member is engaged with this back face 60D by claws provided on the chute 60, such that the metal plate 61 is held in contact with and secured to the back face 60D. Here, the metal plate 61 and the chute 60 may be fixed to each other by a double-faced tape.

Figure 3B:
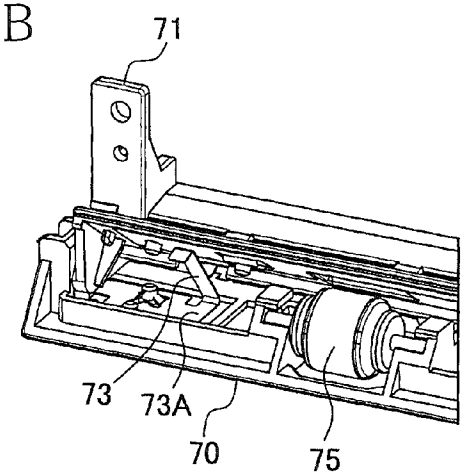
FIG. 3B is a view illustrating a portion of the structure as seen from another angle.

The support member 70 that supports the chute 60 has securing portions 71 at opposite end portions of the support member 70 in its widthwise direction that is a direction perpendicular to the conveying direction and along the face of the sheet P. The support member 70 is secured to the main body frame at these securing portions 71 with screws or other securing components. An electrode 73, cleaning rollers 75, and other components are mounted on a bottom face of the support member 70. The electrode 73 has a flat-spring shape and also acts as a chute urging spring. As illustrated in FIG. 3B from another angle, the electrode 73 has a bottom base portion 73A so as to have the flat-spring shape, and the electrode 73 is held in pressing contact with the metal plate 61, with the bottom base portion 73A fixed to the support member 70. The bottom base portion 73A is grounded, so that the metal plate 61 is also grounded. Here, the metal plate 61 does not need to be grounded and may be floated without electrically grounded. In this design, electricity is never applied to the metal plate 61. The cleaning rollers 75 are well-known cleaning rollers that are brought into pressing contact with the pressure roller 52 to clean portions of the pressure roller 52 which are liable to be stained.

Figure 4A:
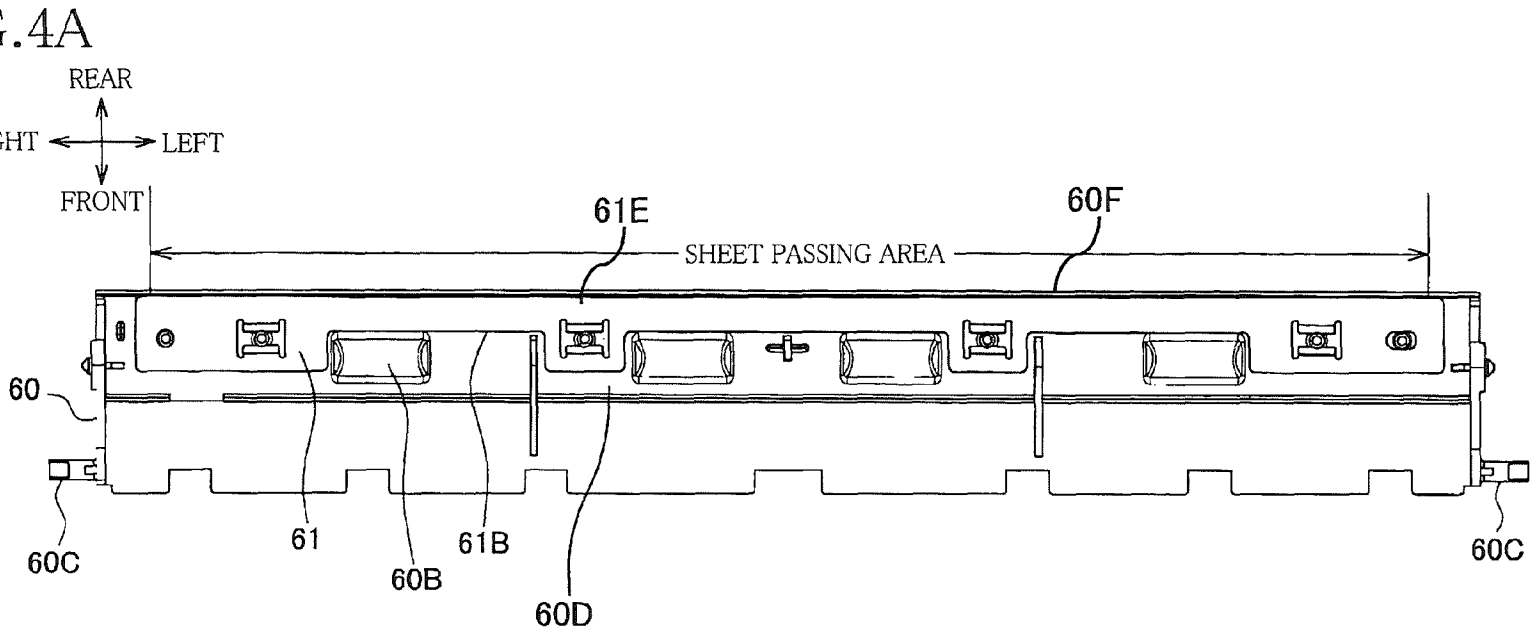
FIG. 4A is a bottom view illustrating a structure of the chute.

FIG. 4A illustrates a structure of the chute 60 (including the metal plate 61) solely. As illustrated in FIG. 4A, the back face 60D of the chute 60 has recessed portions 60B, formed at positions respectively opposed to the cleaning rollers 75, for receiving the respective cleaning rollers 75. A front edge portion of the metal plate 61 also has cutouts 61B for receiving the respective cleaning rollers 75. The metal plate 61 has a rear-end edge portion 61E whose edge extends straight in plan view and parallel to an edge of a rear-end edge portion 60F of the chute 60. Also, assuming that a sheet passing area is an area on which the maximum size of the sheet P available for image forming of the image forming portion 2 is conveyed (that is, the sheet passing area has a width that is equal to that of the maximum size of the sheet P), the metal plate 61 has such a width (i.e., a length in the widthwise direction) that the sheet passing area is within the metal plate 61 in the widthwise direction. Also, shafts or projections 60C are projected from opposite ends of a front end portion of the chute 60 in the widthwise direction. The shafts 60C are provided for supporting the chute 60 pivotably on the support member 70.

It is noted that in an apparatus capable of performing what is called borderless printing for forming an image on an entire width of the maximum size of the sheet P available for the image forming of the image forming portion 2, the metal plate 61 preferably has such a width that the sheet passing area is within the metal plate 61 in the widthwise direction. On the other hand, in an apparatus configured not to be capable of forming an image on an entire width of the sheet (that is, in an apparatus configured to always create margins on a sheet), the metal plate 61 only needs to have such a width that the maximum printing area available for image forming on the sheet P is within the metal plate 61 in the widthwise direction.

Figure 4B:
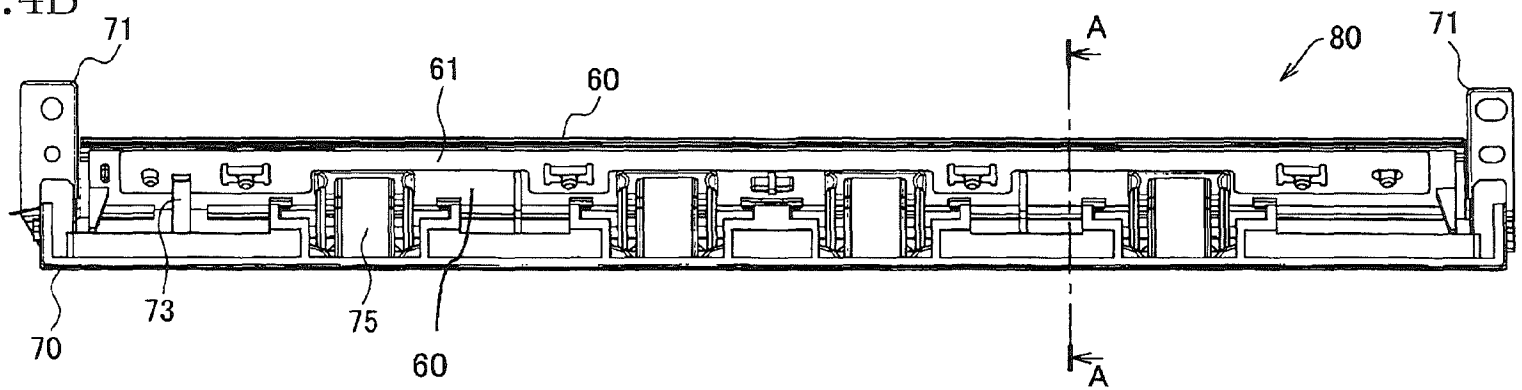
FIG. 4B is a rear view illustrating the assembly.
Figure 5A:
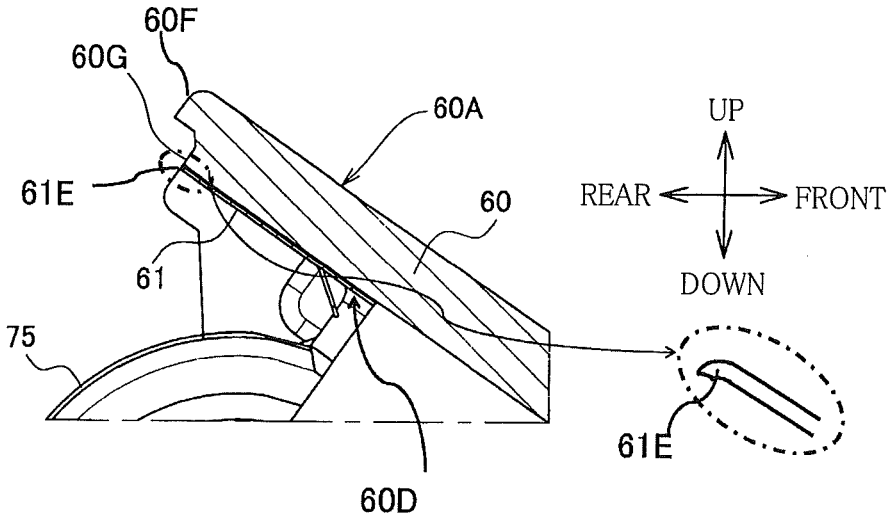
FIGS. 5A and 5B are cross-sectional views each taken along line A-A in FIG. 4B illustrating the assembly.
Figure 5B:
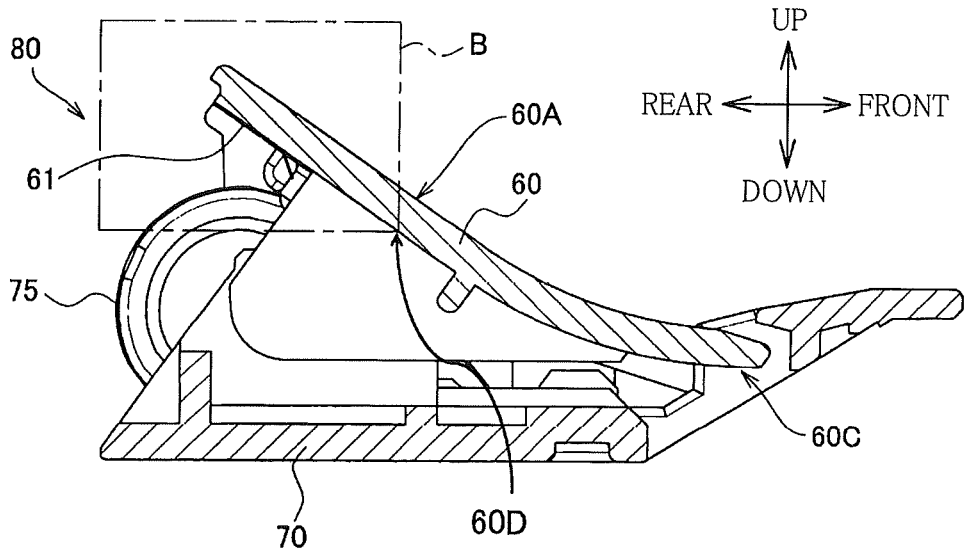

FIG. 4B is a rear view illustrating the chute assembly 80, and FIG. 5B is a cross-sectional view taken along line A-A in FIG. 4B. FIG. 5A is an enlarged view of the area B in FIG. 5B. As illustrated in FIG. 5A, the chute 60 is designed such that a part of the rear-end edge portion 60F near the back face 60D is cut out, creating a back-face rear-end edge portion 60G. Thus, the back-face rear-end edge portion 60G is located upstream of the rear-end edge portion 60F in the conveying direction. Also, the metal plate 61 is disposed such that the back-face rear-end edge portion 60G is substantially flush with the rear-end edge portion 61E of the metal plate 61, that is, the back-face rear-end edge portion 60G and the rear-end edge portion 61E are located at substantially the same position as each other in the conveying direction. In this design, when the sheet P is being conveyed while contacting the chute 60, a portion of the chute 60 which includes the rear-end edge portion 60F is located between the sheet P and the rear-end edge portion 61E of the metal plate 61, preventing the rear-end edge portion 61E of the metal plate 61 from being directly opposed to the sheet P being conveyed while contacting the chute 60. Also, the rear-end edge portion 61E of the metal plate 61 has an edged shape in cross section, that is, the rear-end edge portion 61E has a portion having an acute angle in cross section. Here, the edged cross-sectional shape is such a shape that is formed when the metal plate 61 is cut with press working so as to be punched from its front face to back face and that has an acute portion as in a distal end of the rear-end edge portion 61E illustrated in an enlarged view in FIG. 5A. The edged cross-sectional shape is not a smoothly bent shape like a shape formed by bending a metal sheet. It is noted that a method of forming the edged cross-sectional shape is not limited to the press working and may be laser processing, etching, or any other methods as long as a sharp portion having an acute angle is formed in a cut portion in cross section. The sharp portion preferably has a curvature radius R of equal to or less than 0.1.

As illustrated in FIG. 5B, the chute 60 is supported by the support member 70 so as to be pivotable about the shafts 60C provided on the front end portion, such that a rear end thereof is moved within a predetermined range in an up and down direction. Also, the rear end of the chute 60 is urged upward by the electrode 73 having the flat-spring shape and also acting as the chute urging spring.

Effects of Present Embodiment and Modification

In the present embodiment, as described above, when the chute 60 guides the sheet P to the nip position, the pivotal movement of the chute 60 allows the sheet P to be bent. Specifically, in the image forming apparatus of this kind, a speed at which the sheet P is conveyed at the image forming portion 2 is sometimes set to be lower than a speed at which the sheet P is conveyed at the fixing unit 5 in order to prevent the sheet P from being pulled and tensioned between the image forming portion 2 and the fixing unit 5 during the conveyance of the sheet P. This configuration causes the sheet P to be bent between the image forming portion 2 and the fixing unit 5, but the pivotal movement of the chute 60 can allow such a bend in the present embodiment.

Moreover, since the rear-end edge portion 60F of the chute 60 receives the upward urging force (for urging the rear-end edge portion 60F toward a conveyance path of the sheet P)

from the electrode 73 having the flat-spring shape, the entire sheet P reliably contacts the front face 60A of the chute 60 at a rear end edge of the rear-end edge portion 60F regardless of the magnitude of resilience of the sheet P. This reliable contact results in a fixed distance between the sheet P and the rear-end edge portion 61E of the metal plate 61 regardless of the magnitude of the resilience of the sheet P. Thus, a charged state of the sheet P guided to the fixing unit 5 can be made uniform in the widthwise direction.

That is, the chute 60 is formed of an insulating material, and the metal plate 61 having the thin-plate shape is provided along the rear-end edge portion 60F of the back face 60D. Also, the metal plate 61 is designed such that the rear-end edge portion 61E has the edged cross-sectional shape and has such a width that the entire sheet passing area is within the metal plate 61 in the widthwise direction. Since the metal plate 61 has the edged cross-sectional shape, excessive electric charges on the sheet P passing through the rear-end edge portion 60F of the chute 60 satisfactorily travel to the metal plate 61. Furthermore, since the distance between the sheet P and the rear-end edge portion 61E of the metal plate 61 is fixed as described above at the rear-end edge portion 60F of the chute 60 regardless of the magnitude of the resilience of the sheet P, the travel of the electric charges is not susceptible to the magnitude of the resilience of the sheet P.

Also, even if the sheet P is charged due to friction with the chute 60, electric charges after the charging travel to the metal plate 61 along the rear-end edge portion 60F of the chute 60 as described above. Furthermore, since the metal plate 61 has the above-described length in the widthwise direction, the electric charges travel to the metal plate 61 as described above, whereby the charged state of the entire sheet P on which the image has been formed by the image forming portion 2 can be made uniform in the widthwise direction. Thus, in the present embodiment, the charged state of the sheet P guided to the fixing unit 5 can be made uniform in the widthwise direction, making it possible to suppress generation of image disturbance on the sheet P in streaks along the conveying direction.

Also, in the present embodiment, the rear-end edge portion 61E of the metal plate 61 is flush with the back-face rear-end edge portion 60G that is the cut part of the rear-end edge portion 60F near the back face 60D. Thus, when the sheet P is being conveyed on the chute 60, the metal plate 61 is not opposed directly to the sheet P at least in a direction perpendicular to the face of the sheet P. Therefore, it is possible to more reliably prevent the image disturbance for the following reason.

That is, a result of the charging on the sheet P differs depending upon various conditions such as a type of the sheet P and ambient temperature and humidity. On condition that the sheet P having a high electrical resistance value is used and/or the ambient air is at low humidity, a large amount of the charges are on the sheet P. Thus, if the sheet P and the metal plate 61 are directly opposed to each other, intense electric discharges may be locally generated between the sheet P and the metal plate 61, which may cause image disturbance by, e.g., flying of a developer from a face of the sheet P at an area where the intense electric discharges are generated. In two-side printing, in particular, since thermal fixing is performed at the last step of printing on a first face, humidity of the sheet is low in printing on a second face, resulting in a tendency of generation of charges on the sheet due to friction between the sheet and the chute. Moreover, in a case where printing is performed on a sheet such as a glossy paper to which the developer does not adhere easily when compared with a plain paper, the developer easily flies by the electric discharge, making it difficult to form an image without disturbance. To solve this problem, the metal plate 61 is disposed at the position not opposed directly to the sheet P in the present embodiment. Thus, it is possible to prevent the image disturbance that is caused in a case of a large amount of charges on the sheet P and to cause the excessive electric charges to travel to the metal plate 61 along a rear end face of the chute 60. In the present embodiment, therefore, it is possible to satisfactorily prevent the disturbance in the image formed on the sheet P on various conditions, for example, on the condition that the sheet P is the glossy paper under the low humidity environment.

Figure 6A:
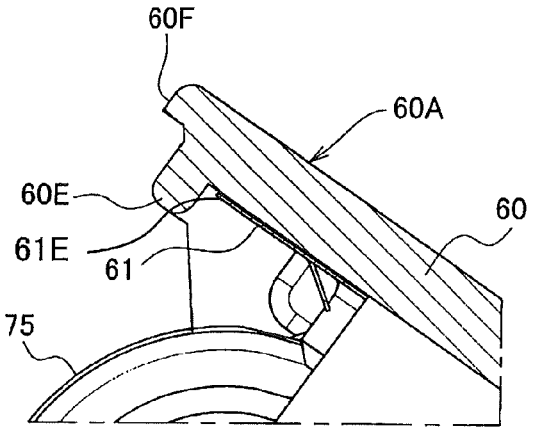
FIGS. 6A and 6B are cross-sectional views each illustrating a structure of an assembly including a chute in a modification.
Figure 6B:
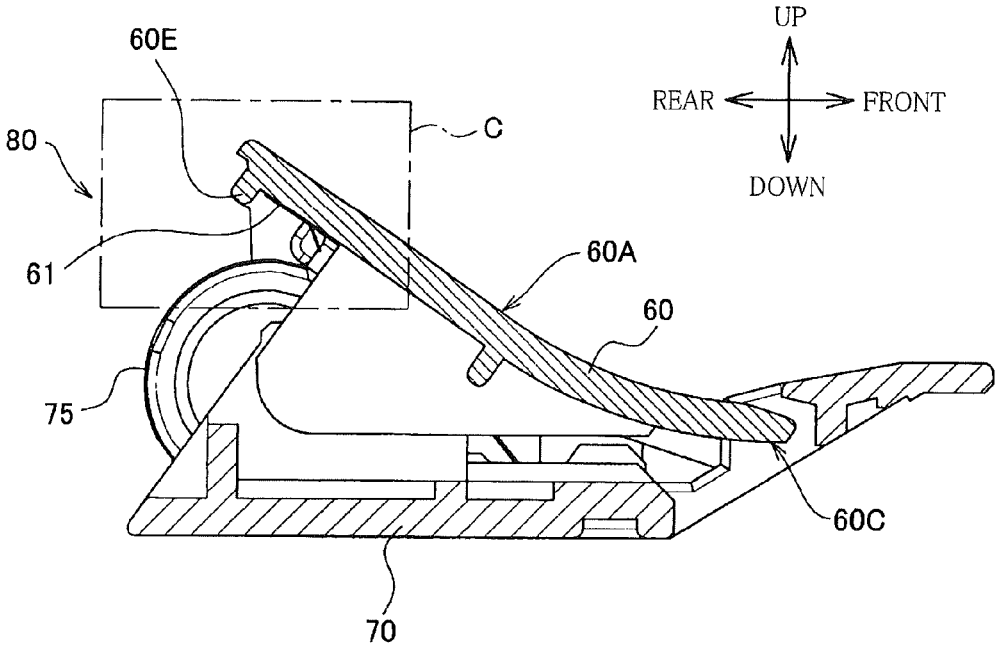
Figure 7:
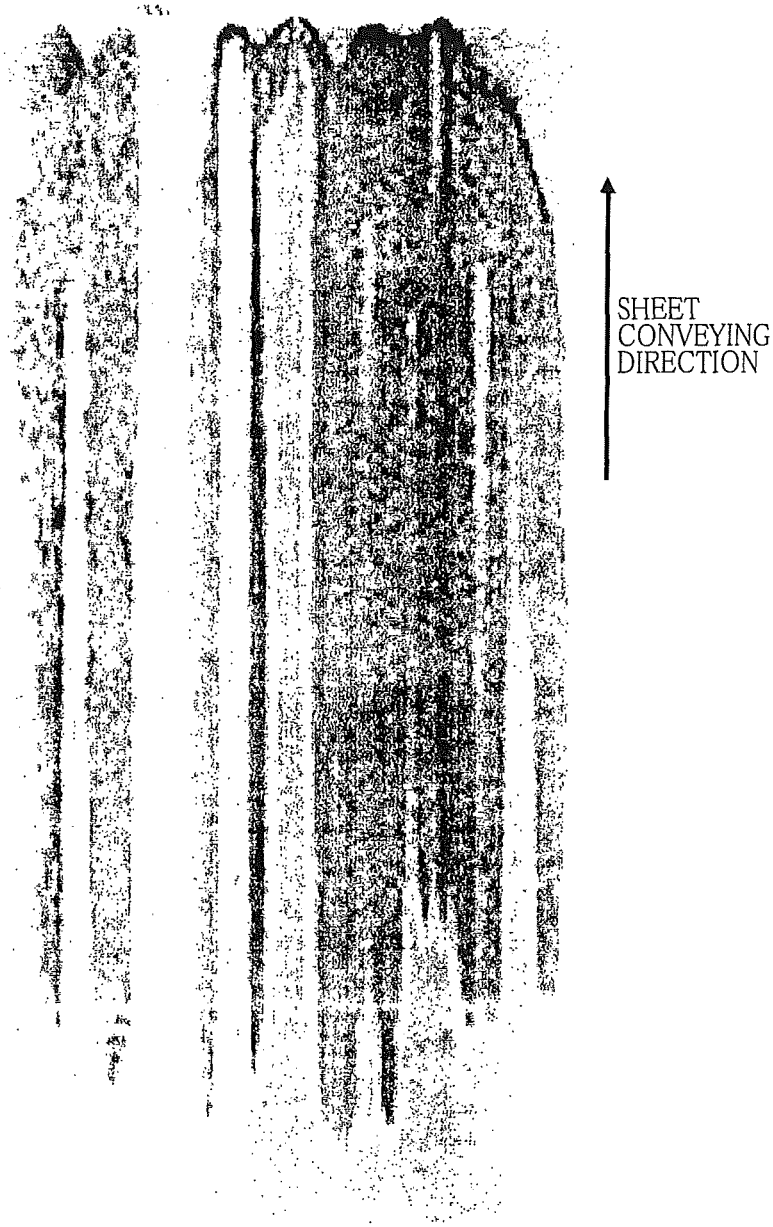
FIG. 7 is a view for explaining a problem to be solved in a conventional technique.

It is noted that, as illustrated in FIGS. 6A and 6B as a modification, a rib 60E may be integrally formed on a rear edge portion of the back face 60D of the chute 60 such that the rib 60E extends across the entire rear edge portion in the widthwise direction. In this design, the metal plate 61 may be disposed such that the rear-end edge portion 61E is formed at a position opposed to a base of the rib 60E so as to expand continuously along the base in a direction perpendicular to the conveying direction. That is, the rib 60E is formed at a part of the rear-end edge portion 60F of the chute 60, which part is cut out near the back face 60D, and the rib 60E extends from the part in a direction that is substantially perpendicular to the back face 60D of the chute 60 and that directs from the front face 60A toward the back face 60D of the chute 60. Also, the rib 60E is disposed downstream of the rear-end edge portion 61E of the metal plate 61 in the conveying direction. Here, the metal plate 61 is disposed such that the rear-end edge portion 61E is exposed without covered with the rib 60E when seen from a side of the metal plate 61, on which side a back (lower) face of the metal plate 61 is located. In this design, the rib 60E makes it possible to prevent the sheet P and the metal plate 61 from being directly opposed to each other in various directions and also makes it possible to suppress and prevent the electric discharge and the image disturbance as in the above-described embodiment though the electric discharge between the sheet P and the metal plate 61 is generated so as to go over the rib 60E. It is noted that FIG. 6A is an enlarged view of the area C in FIG. 6B.

Also, while the edge of the rear-end edge portion 61E of the metal plate 61 extends straight and parallel to the edge of the rear-end edge portion 60F of the chute 60 in the above-described embodiment, the rear-end edge portion 61E may have a saw-toothed shape by working the rear-end edge portion 61E into a multiplicity of needles. It should be understood that, in the case where the rear-end edge portion 61E of the metal plate 61 is formed to have the straight shape as in the above-described embodiment, the electric charges traveled from the sheet P to the metal plate 61 are uniform in the widthwise direction. Thus, the charged state of the sheet P guided to the fixing unit 5 can be made uniform further reliably in the widthwise direction, making it possible to more reliably prevent generation of the image disturbance on the sheet P in streaks along the conveying direction. In addition, in the case where the rear-end edge portion 61E of the metal plate 61 is formed to have the straight shape, the working of the metal plate 61 is easy when compared with the case where the edge is worked into the multiplicity of needles, resulting in reduction in manufacturing cost of the apparatus. Also, in a case where the amount of the charges on the sheet P is not relatively small owing to a property of toner and a condition of transferring, for example, the electric discharge is not easily caused locally. Thus, the rear-end edge portion 61E of the metal plate 61 may project rearward from the rear-end edge portion 60F of the chute 60.

Also, in the above-described invention, the back face 60D of the chute 60 has a portion at which friction is produced by contact between the front face 60A of the chute 60 and the sheet P, and the metal plate 61 may be disposed on the portion of the back face 60D. In this design, even if the sheet P is charged by the friction with the chute 60, the electric charges after the charging can be traveled to the metal plate 61 more reliably, making it possible to prevent the disturbance in the image formed on the sheet P more reliably.

Also, the present invention is not limited to be applied to the color laser printer adopting the direct tandem method like the image forming apparatus 1 and may be applied to a color laser printer adopting an intermediate transfer method and a monochrome laser printer. That is, the transfer conveyor belt is not essential, and the chute may be designed to guide, to the fixing unit, a recording medium conveyed by, e.g., a roller of the image forming unit.

In the image forming apparatus 1, the operation for transferring the toner image to the sheet P is repeatedly performed on the sheet P that is conveyed by the transfer conveyor belt 12C so as to pass through positions respectively opposed to the four photoconductor drums 3A. Thus, the electric charges on the sheet P increase each time when the operation is finished, but in the present embodiment, the excessive electric charges on the sheet P can be satisfactorily traveled to the metal plate 61 as described above, and therefore the effect of the design is significant.

Also, for size reduction, an apparatus such as a color laser printer is sometimes designed such that the fixing unit 5 is disposed in an upper portion of the apparatus, and a sheet conveyance path is bent upward at a rear of the transfer conveyor belt 12C. In this case, the sheet P tends to be rubbed strongly against the chute 60 and charged due to the friction. In the present embodiment, however, the electric charges generated by the friction between the sheet P and the chute 60 can also be traveled to the metal plate 61 satisfactorily as described above, and therefore the effect of the design is significant. Furthermore, in a case where the present invention is applied to an image forming apparatus capable of performing two-side recording, the above-described effects can be satisfactorily obtained.

Also, the metal plate 61 may not be grounded and may be floated. Also in this case, the charged state of the sheet P can be made uniform, and the effects of the invention can be obtained. However, in the case where the metal plate 61 is in the floated state, there is a risk of the metal plate 61 acting as an antenna to cause problems such as noise. Accordingly, the metal plate 61 is preferably grounded.

Also, in the present embodiment, the front face 60A of the chute 60 has no openings, so that the metal plate 61 is not exposed to a side thereof near the front face 60A. That is, in the present embodiment, the chute 60 is urged as described above, eliminating a need to attract the sheet P to the chute 60. Thus, the following operations and effects are produced. That is, in a case where the front face 60A has an opening through which the metal plate 61 is exposed, when the electrical resistance of the sheet P is lowered due to the humidity, there is a case where a transfer current being traveled through the sheet P toward the chute 60 is leaked from the image forming portion 2 to cause failure in the image forming. In the present embodiment, however, it is possible to prevent occurrence of such a situation.

What is claimed is:

1. An image forming apparatus, comprising:

an electrophotographic image forming unit configured to form an image on a recording medium;

a fixing unit configured to thermally fix the image formed on the recording medium by the image forming unit;

a chute formed of an insulating material, the chute being disposed between the image forming unit and the fixing unit, the chute comprising:

a guide face to be contacted by the recording medium; and a back face that is on a back of the guide face, the chute being configured to guide the recording medium on which an image is formed by the image forming unit, to a nip position of the fixing unit in a state in which the recording medium is in contact with the guide face; and a planar metal member disposed on the back face of the chute, the metal member expanding to a first end edge portion that is an end edge portion of one of end edge portions of the chute, wherein a distance between the first end edge portion of the chute and the fixing unit is less than a distance between the other of the end edge portions of the chute and the fixing unit, wherein the metal member comprises a second end edge portion that is an end edge portion of one of end edge portions of the metal member, wherein a distance between the second end edge portion of the metal member and the fixing unit is less than a distance between the other of the end edge portions of the metal member and the fixing unit, wherein the second end edge portion of the metal member has an acute angle in cross section as viewed in a widthwise direction of the recording medium which coincides with a direction perpendicular to a conveying direction in which the recording medium is conveyed, and wherein the second end edge portion of the metal member is uncovered in a direction directed from the second end edge portion of the metal member toward the nip position.

2. The image forming apparatus according to claim 1, wherein a length of the metal member is greater in the widthwise direction than a length of a maximum size of a recording medium that is available for the image forming of the image forming unit.

3. The image forming apparatus according to claim 1, wherein the second end edge portion of the metal member is located at substantially the same position as the first end edge portion of the chute in the conveying direction or upstream of the first end edge portion of the chute in the conveying direction.

4. The image forming apparatus according to claim 1, wherein the guide face of the chute comprises a portion on which the recording medium is to be contacted, and wherein the metal member is disposed on a portion of the back face of the chute, which corresponds to the portion of the guide face of the chute.

5. The image forming apparatus according to claim 1, wherein the metal member is disposed such that, when the recording medium is being conveyed while contacting the chute, at least a portion of the chute is located between the second end edge portion of the metal member and the recording medium in a direction perpendicular to a recording face of the recording medium.

6. The image forming apparatus according to claim 5, wherein the at least the portion of the chute comprises the first end edge portion of the chute.

7. The image forming apparatus according to claim 1, wherein a direction in which the second end edge portion of the metal member extends is substantially parallel to a direction in which the first end edge portion of the chute extends.

8. The image forming apparatus according to claim 1, further comprising a force applying member comprising a first end portion and a second end portion, the force applying member being supported pivotably about the first end portion of the force applying member as a pivot axis such that the second end portion of the force applying member is moved, wherein a distance between the first end portion of the force applying member and the image forming unit is less than a distance between the second end portion of the force applying member and the image forming unit, and a distance between the second end portion of the force applying member and the fixing unit is less than a distance between the first end portion of the force applying member and the fixing unit, wherein the force applying member is configured to apply a force to the chute in a direction in which the first end edge portion of the chute is moved toward a conveyance path through which the recording medium is conveyed.

9. The image forming apparatus according to claim 1, wherein the image forming unit comprises:

a plurality of electrostatic-latent-image bearing members respectively corresponding to a plurality of colors and each having a face on which an electrostatic latent image of a corresponding one of the plurality of colors is to be formed;

a plurality of developing members provided respectively for the plurality of electrostatic-latent-image bearing members and each configured, when an electrostatic latent image has been formed on a face of a corresponding one of the plurality of electrostatic-latent-image bearing members, to apply a developer of a corresponding one of the plurality of colors to the electrostatic latent image to develop the electrostatic latent image; and a conveyor belt configured to convey the recording medium such that the developer on the face of each of the plurality of electrostatic-latent-image bearing members is transferred to the recording medium.

10. The image forming apparatus according to claim 1, wherein the metal member has a front face and a back face, and the front face of the metal member faces the back face of the chute, and wherein the metal member is exposed without being covered with the chute when viewed from a side of the metal member, on which side the back face of the metal member is located.

11. The image forming apparatus according to claim 1, wherein the metal member is secured to the chute in a state in which the metal member is held in contact with the chute.

12. The image forming apparatus according to claim 1, wherein the second end edge portion is formed by press working.

* * * * *